US005542147A

United States Patent [19]

Merten

[11] Patent Number: 5,542,147

[45] Date of Patent: Aug. 6, 1996

[54] SPRAY SUCTION AND AGITATOR CONTROL AND DEEP CLEANING MACHINE

[75] Inventor: David J. Merten, Grand Rapids, Mich.

[73] Assignee: Bissell Inc., Grand Rapids, Mich.

[21] Appl. No.: 432,676

[22] Filed: May 2, 1995

[51] Int. Cl.[6] ..... A47L 11/34

[52] U.S. Cl. ..... 15/321; 15/339; 15/377

[58] Field of Search ..... 15/321, 339, 377, 15/320

[56] References Cited

U.S. PATENT DOCUMENTS

| | | | |
|---|---|---|---|
| 3,663,985 | 5/1972 | Burgoon | 15/377 X |
| 4,245,371 | 1/1981 | Satterfield . | |
| 4,327,459 | 5/1982 | Gilbert | 15/321 |
| 4,349,935 | 9/1982 | Knestele . | |
| 4,447,920 | 5/1984 | Glenn, III et al. . | |
| 4,457,042 | 7/1984 | Jones et al. . | |
| 4,512,057 | 4/1985 | Laing et al. . | |
| 4,542,556 | 9/1985 | Hepple | 15/321 |
| 4,782,550 | 11/1988 | Jacobs . | |
| 4,809,397 | 3/1989 | Jacobs et al. | 15/321 X |
| 4,845,802 | 7/1989 | Miller et al. . | |
| 5,048,148 | 9/1991 | Gleadall | 15/321 |
| 5,101,532 | 4/1992 | Dyson et al. . | |
| 5,210,902 | 5/1993 | Lee et al. . | |
| 5,237,719 | 8/1993 | Dwyer et al. | 15/321 |
| 5,287,587 | 2/1994 | Yonkers et al. . | |
| 5,287,590 | 2/1994 | Yonkers et al. . | |
| 5,400,462 | 3/1995 | Amoretti | 15/321 |

*Primary Examiner*—Chris K. Moore

*Attorney, Agent, or Firm*—Varnum, Riddering, Schmidt & Howlett LLP

[57] ABSTRACT

A deep cleaning/vacuum machine wherein the housing is provided with three separate switches for an agitator (brush), a suction motor, and a cleaning liquid pump. The switches may be conventional switches.

9 Claims, 1 Drawing Sheet

SPRAY SUCTION AND AGITATOR CONTROL AND DEEP CLEANING MACHINE

BACKGROUND OF THE INVENTION

1. Field of the Invention

Figure 2:
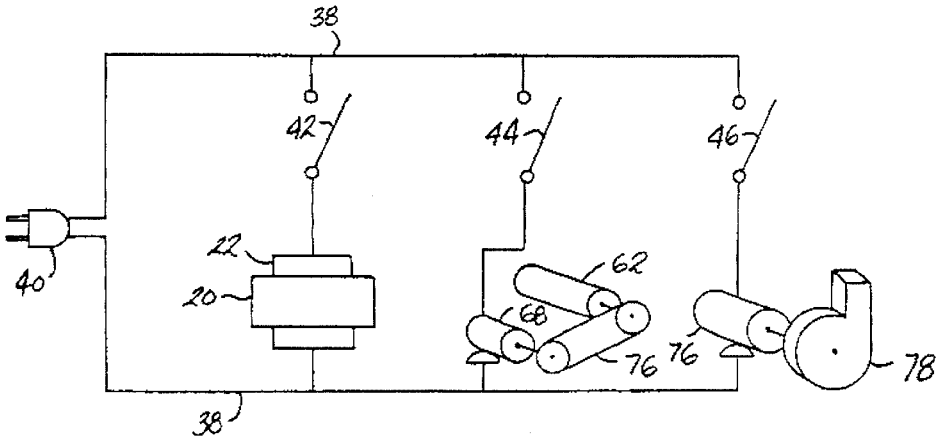

This invention relates to a vacuum cleaning machine wherein a carpet can be sprayed with a cleaning solution, agitated with a rotary brush to scrub the carpet and vacuumed to remove the dirty cleaning solution or dry vacuumed.

2. Description of Prior Art

The U.S. Pat. No. to Blase et al., 5,398,373, issued Mar. 21, 1995, discloses a deep cleaning machine in which a power head is adapted to spray and clean a carpet and is also capable of dry vacuuming a carpeting. A rotary brush is driven by a motor in the head to agitate the carpet. The U.S. Pat. No. to Salmon, 5,075,920, issued, December 1991, discloses a machine to carry out the same function.

The U.S. Pat. No. to Knestele, 4,349,935, issued Sep. 21, 1982, discloses a carpet cleaning machine in which a rotary brush and a carpet shampoo massager are mounted on a rockable arm so that one of the functions of shampoo application or carpet agitation is carried out alternately or neither of the functions is carried out. A suction nozzle 32 is provided between the foam dispenser and the agitator brush to remove liquid from the carpet. Suction can also be applied to the carpet through the brush opening.

The Jones et al. U.S. Patent No. 4,457,042, issued Jul. 3, 1984, and the Glenn, III et al. U.S. Patent No. 4,447,930, issued May 15, 1984, disclose carpet cleaning machines in which a dry chemical carpet cleaning powder is dispensed and agitated into the carpet by a brush and then vacuumed with the assistance of the same brush. The brush rotates counter-clockwise when the powder is distributed and clockwise when the powder is vacuumed. Switches for power, clean and vacuum are mounted on a bracket on the suction/spray hose.

The U.S. Pat. No. to Satterfield, 4,245,371, issued Jan. 20, 1981, discloses a carpet cleaning machine which can be used as a carpet scrubber or a vacuum cleaner. It dispenses a powder but only when the brush of the cleaning head is operated. The suction cannot be used without the brush agitator.

The U.S. Pat. No. to Laing et al., 4,512,057, issued Apr. 23, 1985, discloses a dry powder carpet cleaning machine which can be used as a vacuum cleaner and as a carpet cleaning machine. There do not appear to be any controls for agitation by itself or for powder dispensing by itself.

The U.S. Pat. No. to Yonkers et al., 5,287,587, issued Feb. 22, 1994, discloses a deep cleaning machine for use with a conventional hose, wand and cleaning head, the latter of which has a spray nozzle for spraying a solution onto a carpet and a suction nozzle opening for extracting dirty liquid from the carpet. The dirty liquid is transported through a hose to a canister in which the dirty water is separated from air. A liquid cleaning solution in the canister is pumped through a pump to the spray nozzle. A vacuum motor in the top of the canister drives an impeller to draw a suction in the hose. A single switch operates the spray and pump and the vacuum motor. A deep cleaning machine of this description has been sold by BISSELL Inc. under the mark BIG GREEN CLEAN MACHINE with separate switches for the spray pump and the vacuum motor.

The U.S. Pat. No. to Dyson et al., 5,101,532, issued Apr. 7, 1992, discloses a dry powder dispensing and cleaning machine. The machine has a switch for controlling the dispensing of a dry cleaning powder and agitating the carpet.

The U.S. Pat. No. to Jacobs, 4,782,550, issued Nov. 8, 1988, discloses a programmable deep cleaning machine in which a brush and suction are operated by the same motor and a foam is distributed separately.

The U.S. Pat. No. to Miller et al., 4,845,802, issued Jul. 11, 1989, discloses a carpet cleaning attachment for an existing carpet cleaner device having a flexible attachment hose wherein the attachment is capable of extracting both wet and dry materials.

The U.S. Pat. No. to Lee et al., 5,210,902, issued May 18, 1983, discloses a vacuum cleaner in which a conventional canister vacuum cleaning machine is connected to a liquid separator and collector for dirty water.

SUMMARY OF THE INVENTION

According to the invention, a vacuum cleaner and deep cleaner has a housing and a cleaning head wherein the housing has three switches which independently control two motors carried by the housing and a separate motor in the cleaning head. The housing has a vacuum chamber and a solution chamber. A vacuum motor mounted in the housing drives a suction device for drawing suction in the vacuum chamber. A pump in the housing is connected to the solution chamber for pumping solution from the solution chamber through a pump outlet. The cleaning head comprises a spray nozzle for spraying a cleaning solution onto a carpet, an agitator for agitating the carpet, an agitator motor connected to the agitator for driving the agitator and at least one suction nozzle for drawing dirty liquid and/or dirty air from a surface beneath the cleaning head. A hose is connected between the vacuum chamber and the at least one suction nozzle in the cleaning head. A tubing is connected between the pump output and the spray nozzle. An electrical power source is connected to the vacuum motor, the pump and the agitator motor. A switch between the electrical power source in each of the vacuum motor, the pump motor and agitator motor independently controls each of the vacuum motor, the pump motor and the agitator motor.

All of the three switches are preferably mounted on the housing. The three switches are also preferably connected to a single power source which includes a cord and a plug.

IN THE DRAWINGS

Figure 1:
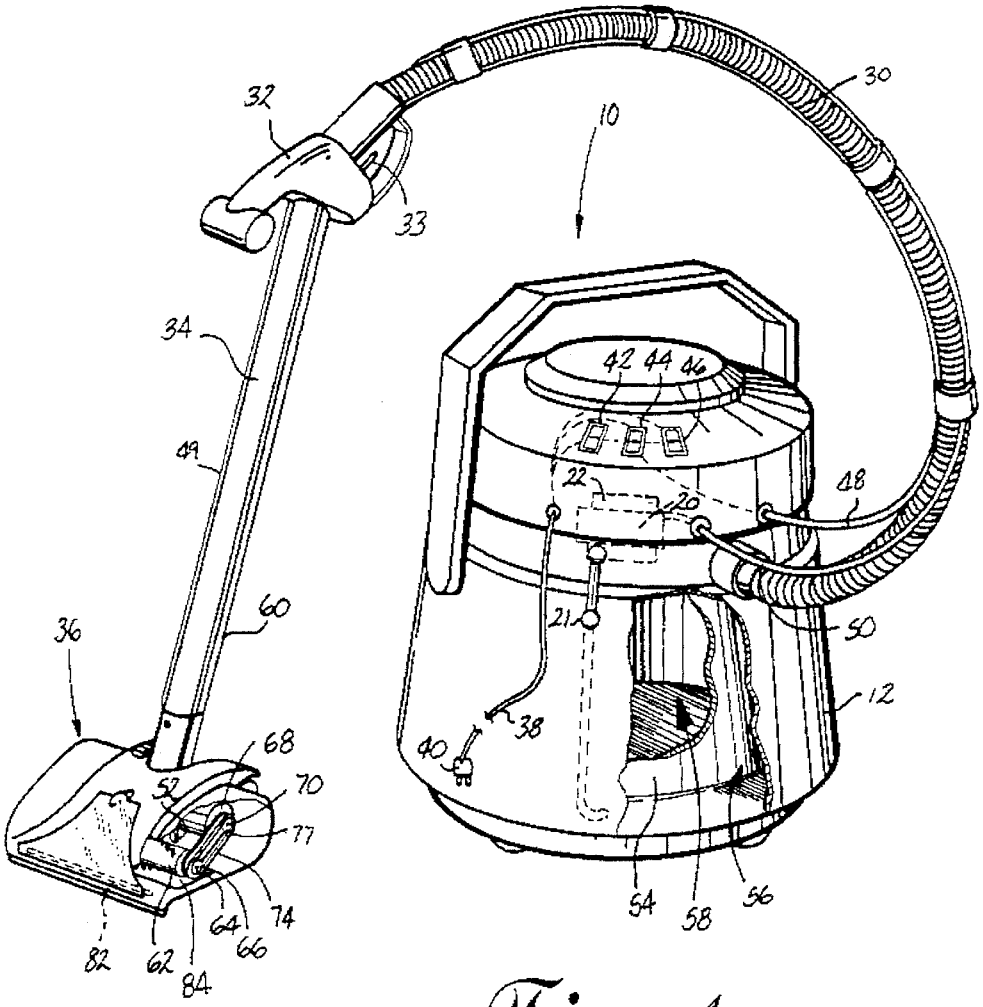

The invention will now be described with reference to the accompanying drawings in which:

FIG. 1 is a perspective view of a vacuum/deep cleaning machine embodying a three-switch control system according to the invention; and FIG. 2 is a wiring diagram showing the control system for the vacuum/deep cleaning machine according to the invention.

PREFERRED EMBODIMENT OF THE INVENTION

Referring now to the drawings in detail, there is illustrated a deep cleaning machine 10. The illustrated machine 10 includes a canister 12 which is provided with a chamber 58 for dirty water and a chamber 56 for cleaning solution. The chambers 56 and 58 are separated by an interior tubular wall 54. Thus, the solution chamber 56 is formed by the bottom wall of the canister 12, the outer side wall of the canister 12 and the interior tubular wall 54. A pump 20 is connected to a segmented conduit 21 which extends into the bottom of the cleaning solution chamber 56 for pumping the cleaning liquid therefrom. The pump 20 is driven by a motor 22. The dirty water compartment 58 is a vacuum compartment and is provided with an impeller 78 which is driven by a motor 76. A suitable canister with these components is disclosed in U.S. Pat. No. 5,287,587 and U.S. Pat. No. 5,287,590, which are incorporated herein by reference. The canister is conventionally equipped with a power cord 38 which terminates in a plug 40. The power cord 38 extends into the canister and is connected to the switches 42, 44 and 46.

The canister 12 has extending therefrom a flexible vacuum hose 30 which preferably terminates in a handle 32 having a trigger mechanism 33. The handle 32 is connected to a wand 34 which is in turn connected to a power head 36. The pump 20 has an output conduit which is connected to tubing 50. Tubing 50 extends from the canister 12 along the vacuum hose 30 to the trigger mechanism 33 which is normally closed. Squeezing of the trigger mechanism 33 in a conventional fashion opens the tubing for fluid flow therethrough. The trigger mechanism 33 is connected to a spray head 52 in the power head 36 through a conduit 60.

The switch 44 is also connected to the power cord 38 and to a power cord 48 which extends from the canister along the vacuum tubing 30, through the handle 32 (which has a conventional disconnect) and through a cord 49 to the power head 36.

The power head 36 has a brush agitator 62 rotatably mounted therein for agitating a carpeting. The brush agitator has an output shaft 64 which mounts a pulley 66. The brush agitator 62 is driven by an agitator motor 68 having an output shaft 70 and a pulley 72. A belt 74 connects the pulleys 72 and 66 to drive the brush agitator 62. The power head 36 also has a first suction nozzle 82 for removing dirty solution and a larger second suction nozzle 84 for dry vacuuming. The power head, including the nozzles, is more fully described in U.S. Pat. No. 5,398,373, which is incorporated herein by reference.

The vacuum motor 22 (not shown in FIG. 1) is mounted to the upper portion of the canister 12 in a manner disclosed in U.S. Pat. Nos. 5,287,587 and 5,287,590 and includes an impeller 78 for drawing suction in the suction chamber 58. Water is separated from air in the suction chamber 58 in a manner described in U.S. Pat. Nos. 5,287,587 and 5,287,590.

Referring now to FIG. 2, there is shown a wiring diagram for the control of the vacuum/deep cleaning machine according to the invention. As shown in FIG. 2, the switch 42 which controls the power to the pump motor 22 is connected across the wires of the power cord 38. The switch 44 which controls the power to the agitator motor 68 is connected in parallel to the switch 42 and motor 22 across the wires of the power cord 38. The cord 38 is likewise connected to switch 46 which controls the power to the suction motor 76. The suction motor 76 drives a conventional impeller 78. As seen from FIG. 2, the switches 42, 44 and 46 are connected in parallel and operate independently of each other. Each of these switches control a separate function, i.e., the pump motor 22, the agitator motor 68, and the suction motor 76. Thus, the functions of spraying, carpet agitation and vacuum are independently controlled so that they can be operated independently of each other, either alone or in combination with each other.

The three independent control switches according to the invention provide a great advantage in that the operator of the machine can control the functions independently of each other. For example, the carpet can be sprayed without the agitator or the suction operating to make sure that the carpet is adequately covered. Then, the agitator can be operated independently of the spray and vacuum. Finally, the vacuum can be operated independently of the spray and agitation. The vacuum can be operated by itself or with the spray or, alternatively, with the agitator. Further, the suction, agitation and solution spray can also be accomplished simultaneously with one another.

Other than the independent switches 42, 44 and 46, the vacuum/deep cleaning machine operates in a manner as disclosed in U.S. Pat. No. 5,398,373.

Although the invention has been described with respect to a canister having a hose connection to a power head through a wand, the invention can also be used on an upright deep cleaner/vacuum cleaner machine which is self-contained.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. A combined vacuum cleaner and deep cleaner comprising:

a housing having a vacuum chamber and a solution chamber;

a vacuum motor mounted to the housing for driving a suction device for drawing suction in the vacuum chamber;

a pump mounted to the housing and connected to the solution chamber for pumping solution from the solution chamber to a pump outlet;

a pump motor drivingly connected to the pump;

a cleaning head comprising:

a spray nozzle for spraying a cleaning solution onto a carpet;

an agitator for agitating a carpet;

an agitator motor in the cleaning head and connected to the agitator for driving the agitator;

at least one suction nozzle for drawing dirty liquid and/or dirty air from a surface beneath the cleaning head;

a hose connection between the vacuum chamber and the at least one suction nozzle in the cleaning head;

a tubing connection between the pump output and the spray nozzle;

an electrical power source connected to the vacuum motor, the pump motor and the agitator motor;

the improvement which comprises:

a switch mounted on said housing between the electrical power source and each of the vacuum motor, the pump motor and the agitator motor for independent control of each of said vacuum motor, the pump motor and the agitator motor.

2. The combination of claim 1 wherein said three switches are connected to a single power source.

3. The combination of claim 2 wherein said power source is a plug.

4. The combination of claim 1 wherein said three switches are connected to a single power source.

5. The combination of claim 1 wherein said power source is a plug.

6. A combined vacuum cleaner and deep cleaner comprising:

a housing having a solution chamber;

a cleaning head connected to the housing and comprising:

a spray nozzle for spraying a cleaning solution onto a carpet;

an agitator for agitating a carpet;

an agitator motor in the cleaning head and connected to the agitator for driving the agitator;

at least one suction nozzle for drawing dirty liquid and/or dirty air from a surface beneath the cleaning head;

a vacuum motor mounted to the housing for driving a suction device for drawing suction in the or each suction nozzle;

a pump mounted to the housing and connected to the solution chamber and to the spray nozzle for pumping solution from the solution chamber to the spray nozzle;

a pump motor drivingly connected to the pump;

a fluid conduit between the suction device and the or each suction nozzle in the cleaning head;

an electrical power source connected to the vacuum motor, the pump motor and the agitator motor;

the improvement which comprises a switch mounted on said housing between the electrical power source and each of the vacuum motor, the pump motor and the agitator motor for independent control of each of the vacuum motor, the pump motor and the agitator motor.

7. The combination of claim 6 wherein said three switches are connected to a single power source.

8. The combination of claim 6 wherein said power source is a plug.

9. A combined vacuum cleaner and deep cleaner according to claim 6 wherein the switches between the electrical power source and each of the vacuum motor, the pump motor and the agitator motor are mounted in close proximity to each other.

* * * * *